United States Patent [19]

Casdas et al.

[11] Patent Number: 4,654,133

[45] Date of Patent: Mar. 31, 1987

[54] HALL-HEROULT ELECTROLYSIS TANK WITH ASYMMETRICAL CATHODIC BARS AND HEAT INSULATION

[75] Inventors: Spyridon Casdas; Bernard Langon; Laurent Michard, all of St Jean de Maurienne, France

[73] Assignee: Aluminium Pechiney, Paris, France

[21] Appl. No.: 818,699

[22] Filed: Jan. 14, 1986

[30] Foreign Application Priority Data

Feb. 7, 1985 [FR] France ..... 85 02074

[51] Int. Cl.[4] ..... C25C 3/08; C25C 3/16

[52] U.S. Cl. ..... 204/243 M; 204/244

[58] Field of Search ..... 204/243 R, 244 M, 245–247, 204/67

[56] References Cited

U.S. PATENT DOCUMENTS

| | | | |
|---|---|---|---|
| 4,224,127 | 9/1980 | Schmidt-Hatting | 204/243 M |
| 4,313,811 | 2/1982 | Blanc | 204/243 M |
| 4,359,377 | 11/1982 | Blanc et al. | 204/243 M |

*Primary Examiner*—Donald R. Valentine

*Attorney, Agent, or Firm*—Dennison, Meserole, Pollack & Scheiner

[57] ABSTRACT

The invention concerns a tank for the production of aluminum using the Hall-Heroult process by the electrolysis of alumina in a molten cryolite-base bath in an assembly formed by the grouping in series of a plurality of aligned tanks, each tank being formed by a rectangular metal casing whose major axis is perpendicular to the axis of the series and whose interior comprises a heat-insulating lining, a cathode formed by the juxtaposition in sealed relationship of carbonaceous blocks in which metal cathodic bars are sealed, the two ends of the cathodic bars, which issue from the carbonaceous blocks, forming the cathodic outputs which extend to the outside of the casing on the upstream and downstream sides thereof, in relation to the direction of flow of the current in the series, and to which there are connected the conductors for making an electrical connection with the following tank in the series; wherein in accordance with the invention, and in order to make the ohmic resistance of the two groups of upstream and downstream circuits, 11 and 13, substantially equal, in spite of their differences in length, the ohmic resistance of the ends of the downstream cathodic bars, 15, is higher than the ohmic resistance of the ends of the upstream cathodic bars 14. Equality of ohmic resistance as between the upstream and downstream circuits is achieved either by making the downstream cathodic outputs 15 of a material having a higher degree of resistivity than that of the material forming the upstream cathodic outputs 14, or by increasing the length and/or reducing the section of the downstream outputs 15.

5 Claims, 7 Drawing Figures

HALL-HEROULT ELECTROLYSIS TANK WITH ASYMMETRICAL CATHODIC BARS AND HEAT INSULATION

The present invention concerns electrolysis tanks for the production of aluminum using the Hall-Heroult process. More particularly it is concerned with tanks which are disposed crosswise in a series, that is to say, wherein the major axis of each tank is perpendicular to the axis of the series of tanks.

STATEMENT OF PRIOR ART

1. Cathodic Bed

The cathode of a Hall-Heroult electrolysis tank is formed by the juxtaposition of an assembly of carbonaceous blocks which in their underneath face are provided with one or more grooves into which steel bars of square, rectangular or circular cross-section are generally sealed by casting therein, the conductors forming the connections between the successive tanks forming a series being connected to the ends of the steel bars. The blocks are joined by a carbonaceous paste referred to as a luting paste or are stuck together by carbonaceous glues, the characteristics of which are known to one skilled in the art.

The cathode must be sealed with respect to the liquid aluminum which is deposited at a temperature of between 940° and 1000° C. in the electrolysis of alumina dissolved in the molten cryolite bath. It collects the electrical current which flows vertically through the tank, passing in succession into one or more carbonaceous anodes, the cryolite bath, the liquid aluminum and the cathode. The cathode is electrically connected to aluminum, or copper, conductors which carry the current to the following tank in the series. The connection is produced by welding, brazing, or clamping of the ends of the steel bars to a flexible conductor of aluminum or copper which is itself welded to the conductor for carrying the current.

In the case of tanks which are referred to as crosswise tanks, that is to say tanks which are disposed in such a way that the axis thereof is perpendicular to the axis of the series, the cathodic blocks are disposed in parallel relationship to the axis of the series, as shown in FIG. 1. In that case the electical connection to the following tank is made by means of two conductor circuits referred to as:

the upstream circuit which connects the ends of the bars which are directed in the upstream direction of the series with respect to the direction of the current in the series, to the following tank; and the downstream circuit which connects the ends of the bars which are directed in the downstream direction of the series, with respect to the direction of the current in the series, to the following tank.

Statement of the Problem

One of ordinary skill in the art is aware that serious disturbances in the stability of the layer of liquid alumium which is deposited on the cathode occurs if electrical asymmetry in the tank causes more current to pass by way of the downstream side of the tank than the upstream side. That is due to the presence of currents which re referred to as "catch-up" currents which come out of the downstream anodes to go into the upstream circuit, or vice-versa. They interact with the magnetic fields which are produced in electrolysis tanks to produce in the liquid aluminum internal forces which are sufficient to trigger off powerful movements involving the whole of the metal layer. The efficiency of the electrolysis process, which is usually between 90 and 95%, then drops severely and falls to values of lower than 80% and even 70%.

In order to remedy that defect, the tanks are usually constructed symmetrically with respect to the vertical axis passing through the center thereof or with respect to a vertical plane containing the longitudinal axis of the tank. That symmetry concerns the anodic system and the cathodic system, see FIG. 2.

Ideally, the electrical resistance of the upstream circuit should be identical to that of the downstream circuit in order to achieve a condition of electrical symmetry in respect of the cathode. That is attained by increasing the section of the upstream circuit which is longer and reducing the section of the downstream circuit. If L and S are respectively the length and the section of the upstream circuit and if l and s are the length and the section of the downstream circuit, those values must be such that:

$$L/S = l/s \text{ (Ohm's law).}$$

As the section of a circuit cannot be reduced to an excessive degree as, would cause heating up, which could cause a deterioration in the quality of the welds and contacts, the degree of reduction in cross-section is usually very limited. In that case, in order to balance the circuits, it is necessary either to increase S beyond the value which is strictly necessary, or to increase the length L by including extra roundabout portions in the downstream circuit, see FIG. 3 and FIG. 4. In both csaes the total weight of the circuits is increased, together with the cost of the installation.

2. Thermal Insulation

The heat produced in the electrolysis tank feeds the electrochemical reactions on the one hand and the fluxes of thermal losses on the other hand. Such losses are reduced to the maximum degree by using insulating refractory materials. Thermal insulation is such that the heat flux discharged by way of the upper part of the side walls is sufficient to maintain, between the liquid phases and the side walls, a self-producing lining of solidified bath, which is referred to as the embankment. The presence of the embankment at that location makes it possible to protect the metal crucible from corrosion by the liquid bath and aluminum. It is important for the lower part of the embankment not to come forward to an excessive degree over the cathodic blocks as, by reducing the active surface area thereof, it would tend to give rise to catch-up currents similar to those which have already been referred to above, and also to increase the voltage drop at the terminals of the tank.

In principle, when a condition of electrical symmetry is achieved, symmetrical heat insulation ensures that the tank enjoys symmetrical distribution of temperature within the electrolysis tank and in particular symmetrical embankments. It is for that reason that, in working out the theoretical calculations intended to provide the heat insulation, designers are usually content to work on one half of the tank, taking the view that the other half is deduced therefrom by symmetry. Experience shows that in very many cases one side of the tank is colder than the other and the embankment on that side comes forward, at its lower part, over the cathodic blocks, to a slightly greater degree; that results in poor equilibrium in the layer of metal due to its reaction to the magnetic fields, as indicated above.

The above-mentioned thermal asymmetry may be explained by the differences in geometry in the conductors between the upstream and downstream sides, which induce differences in the thermal fluxes which are discharged to the exterior by the tank, or else by the asymmetry of the ranges of speed of the liquid phases in the tank, which have the result that convection exchange between the embankment and the liquids occurs in a privileged fashion on one side in relation to the other.

SUMMARY OF THE INVENTION

The invention concerns a tank for the production of aluminum in accordance with the Hall-Herould process by the electrolysis of alumina in a molten cryolite-base bath, in an assembly formed by the grouping in series of a plurality of aligned tanks, each tank being formed by a rectangular metal casing whose major axis is perpendicular to the axis of the series and the interior of which comprises a heat-insulating lining, a cathode formed by the juxtaposition in sealed relationship of carbonaceous blocks in which metal cathodic bars are sealed, the two ends of the bars, which come out of the carbonaceous blocks, forming cathodic outputs which extend to the outside of the tank at the upstream and downstream sides, in relation to the direction of flow of the current in the series, and to which there are connected the conductors for making an electrical connection with the following tank in the series, said conductors, with the corresponding cathodic outputs, forming an upstream and a downstream circuit. Each tank further comprising an anodic system which is suspended from a horizontal anodic bus assembly which is adjustable in respect of height, said system comprising two parallel lines of anodes in relation to the major axis of the casing, said anodes which are formed by carbonaceous blocks being themselves suspended removably from the anodic bus assembly by conducting metal rods of which the lower part is sealed in the carbonaceous block, the anodic bus assembly being supplied with current by the upstream and downstream circuits of the preceding tank in the series, the tank being characterized in that, in order to make the ohmic resistance of the two groups of upstream and downstream circuits substantially equal, in spite of their difference in length, the ends of the downstream cathodic bars are of an ohmic resistance that is higher than the ohmic resistance of the ends of the upstream cathodic bars.

The invention is based on a novel design of the tank which can be referred to as asymmetric, as the condition of symmetry of the cathodic assembly and the heat insulation in relation to the longitudinal axis of the tank, is done away with.

The doing away with the symmetry concerns two points: the cathodic assembly and the thermal insulation of the tank.

The cathodic blocks are of graphitic or amorphous carbonaceous material and are grooved in their base and also comprise one or more steel bars which are sealed in the grooves. The cathodic bars or at least the parts of the bars which issue from the carbonaceous block are of different section and/or length depending on whether the downstream side or the upstream side of the tank is being considered. The cross-sections of the steel bars are calculated in such a way that the necessary electrical resistance of the upstream circuit is substantially higher than the necessary electrical resistance of the downstream circuit in order electrically to balance the tank, that is to say, in order for the current strength through the upstream circuit to be identical to that passing through the downstream circuit. That is achieved in particular by reducing the cross-section of the portion of the steel bar which is external to the cathodic block on the downstream side with respect to the section of the portion of the steel bar which is external to the cathodic block on the upstream side and by increasing the length of the portion of steel bar which is external to the block on the downstream side. It is also possible for the downstream output to be made of a material which is less conductive, for example chromium stainless steel, and/or for the upstream output to be made of a more conductive material than iron, for example copper.

The tank of the present invention preferably includes an insulating lining which is asymmetric with respect to the longitudinal axis of the tank. In fact, the strength of the current being the same on the two sides and the electrical resistance of the bars being higher on the downstream side than the upstream side, a greater amount of heat is given off on the downstream side. In addition, the thermal resistance of the bars is also higher on the downstream side and therefore that side has better heat insulation. It is consequently preferable to reduce the insulation on the downstream side and/or to over-insulate the upstream side in order to ensure that the tank has the correct thermal equilibrium, having regard moveover to the asymmetry of the temperatures and the embankments which are found on tanks with conventional heat insulation. Calculation of the adequate amount of heat insulation to establish such thermal asymmetry is by known formula, familiar to one of ordinary skill in the art, which formula is not part of the invention.

BRIEF DESCRIPTION OF THE DRAWINGS

FIG. 1 is a top plan view diagrammatically showing the arrangement of the tanks in a series referred to as a "crosswise" series, and for simplicity only showing the arrangement of the cathodic blocks and bars on one of the tanks;

FIG. 2 is a schematic view in vertical section, in a crosswise direction, of a conventional electrolysis tank;

FIGS. 3 and 4 are schematic vertical sectional views showing the connecting circuits between one tank and the following tank in the series, in accordance with the prior art;

FIG. 5 shows an enlarged vertical sectional view of a cathodic block according to the invention;

FIG. 6 shows, in reduced scale, the block of FIG. 5 in position in an electrolysis tank; and FIG. 7 shows the connecting circuits between one tank and the following tank in the series according to the invention.

DETAILED DESCRIPTION OF THE PRIOR ART

Figure 1:
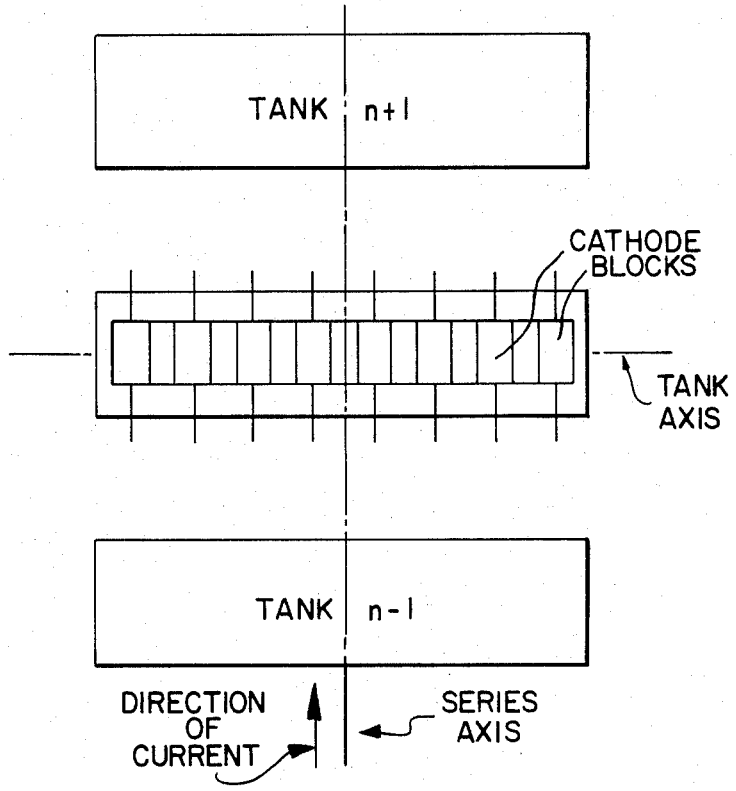
FIG. 1 PRIOR ART
FIGS. 1 to 4 relate to the prior art.
Figure 2:
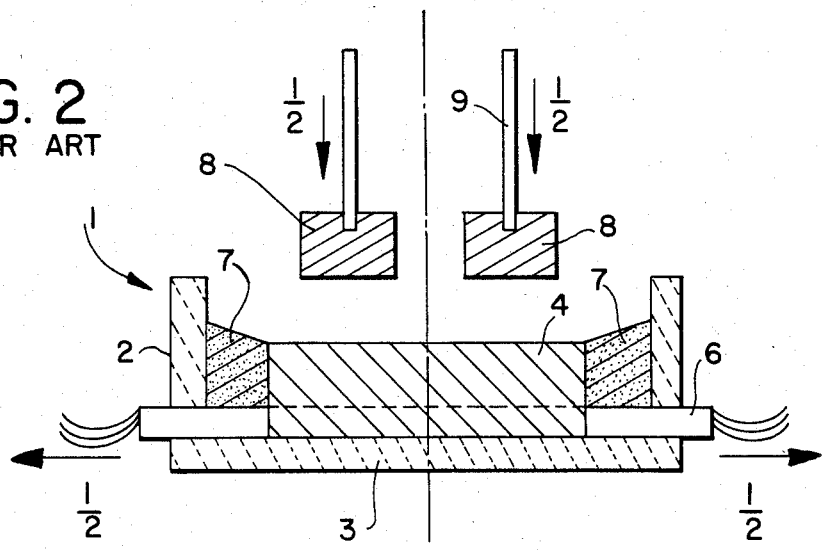
FIG. 2 PRIOR ART

Reducing it to its essential component, each tank 1 comprises a metal casing 2, a heat-insulating lining 3, a cathode 4 formed by the juxtaposition of carbonaceous blocks 5 in which steel bars 6 are sealed, and a luting 7 of carbonaceous paste.

The anodes 8 which are suspended by rods 9 connected by a mechanical clamping action to the current supply bars 10, anodic bus assembly, are in most cases disposed in two parallel lines.

The electrical connection between one tank 1A and the following 1B in the series is made by a first group of conductors 11 referred to as the "upstream circuit", of a length L and a section S which connects the upstream cathodic outputs 12 of the tank 1A to the bus assembly 10 of the following tank 1B, and by a second group of conductors 13 referred to as the "downstream circuit", of a length l and a section s, which connects the downstream cathodic outputs 12' of the tank 1A to the same bus assembly 10 of the following tank 1B.

Figure 3:
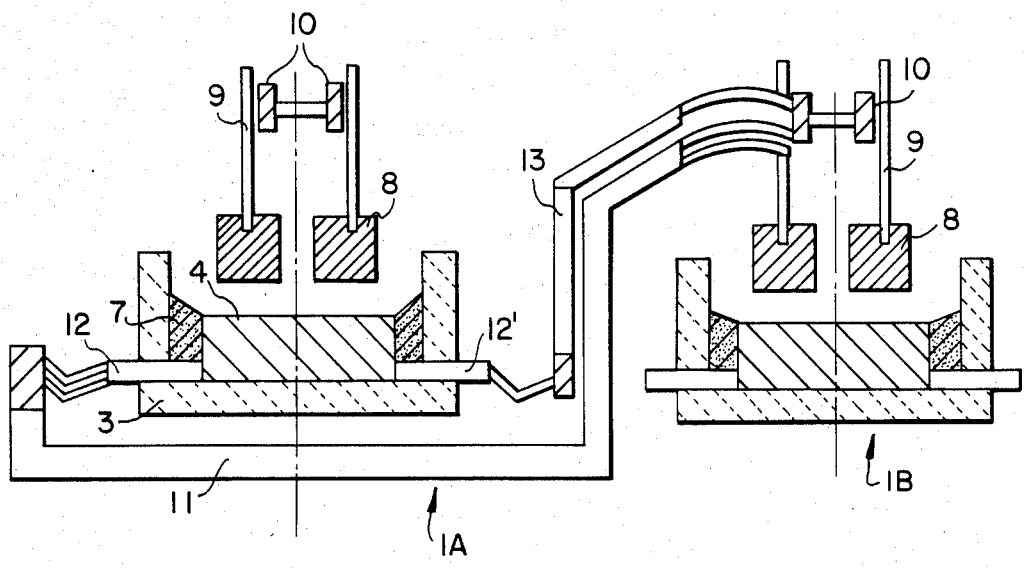
FIG. 3 PRIOR ART

It will be seen from FIG. 3 that the cross-section S of the upstream circuit has been selected to be much greater than the cross-section s of the downstream circuit so as approximately to reestablish a condition of electrical equilibrium between the two, but at the cost of a substantial level of capital investment in respect of aluminum bars. As has been explained hereinbefore, the reduction in section s cannot exceed a limit beyond which the degree of heating of the circuits 13 would become unacceptable.

Figure 4:
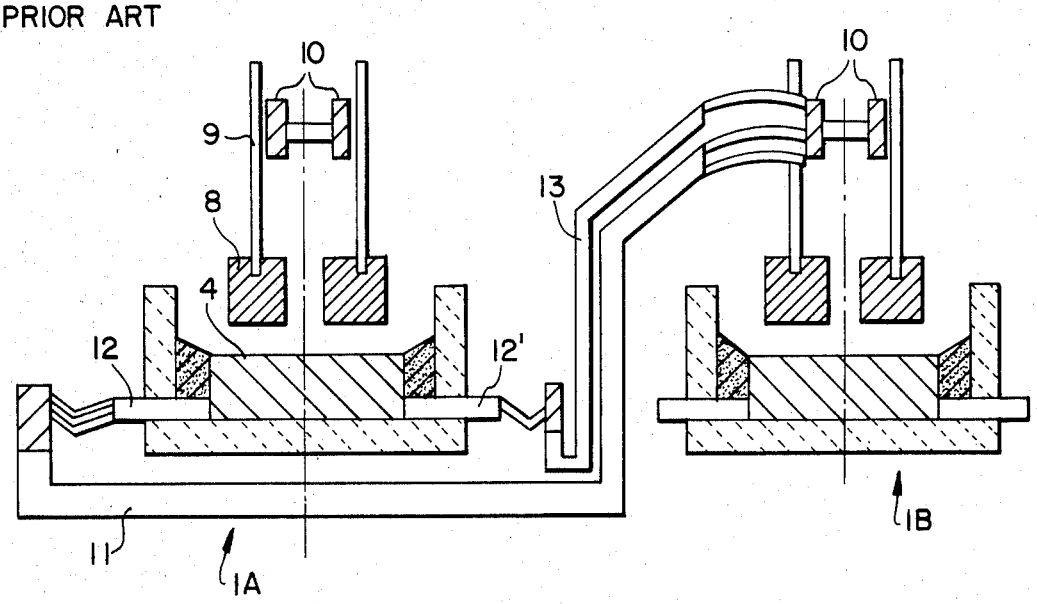
FIG. 4 PRIOR ART

In FIG. 4, electrical balance has been improved by increasing the length of the path followd by the upstream circuit 13.

These various solutions are generally unsatisfactory and do not completely solve the problem of balancing the upstream and downstream circuits.

DETAILED DESCRIPTION OF THE INVENTION

Figure 5:
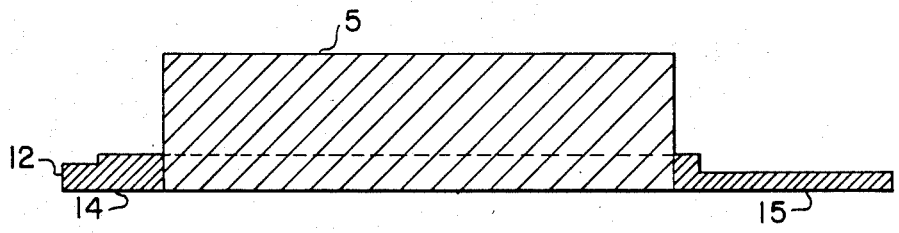
FIGS. 5 to 7 illustrate the manner of carrying the invention into effect.

The solution being the subject-matter of this invention is shown in FIG. 5: compensation in respect of the imbalance of the upstream and downstream circuits is effected at the location of the steel bars 12 which are sealed into the cathodic blocks 5 and which collect the current which has just passed through the electrolysis system.

The upstream output 14 has its section maintained unchanged whereas the downstream output 15 is both reduced in section and increased in length, those two factors contributing to an increase in its ohmic resistance.

Figure 6:
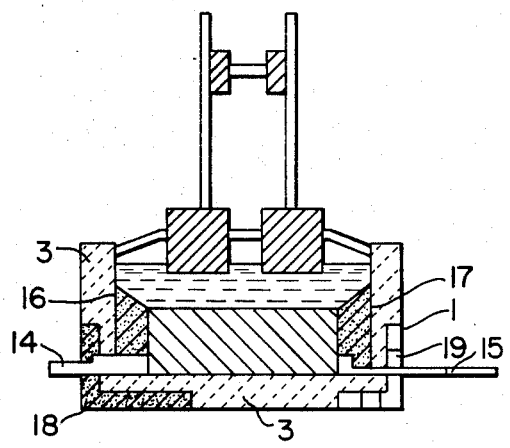

FIG. 6 shows a tank in which cathodic blocks according to the invention have been set in position. Because the voltage drop in the upstream cathodic bar 14 is much less than the drop in the downstream cathodic bar 15, for example in a ratio of 1 to 4, that results in a thermal imbalance between the upstream lining 16 and the downstream lining 17, which has reprecussions on the general balance, thermal, electrical and magnetic, of the whole of the tank, as has been explained above. Therefore, it is necessary either to reduce the insulation on the downstream side, for example by replacing a portion of the heat-insulating lining 3 of the refractory bricks by a local lining 19 which is more conductive, for example of dense aluminous bricks or of a mixed material comprising a refractory+product of the same carbonaceous material or conversely, to increase the upstream lining by the choice of the nature and thickness of the insulating bricks 18 or by applying heat-insulating linings to the outside wall of the metal casing 1 or by any other equivalent means involving the nature and/or the thickness of the heat insulation or the heat exchange phenomena between the casing and the ambient air, acting on the upstream side and on the downstream side or on both at once.

Figure 7:
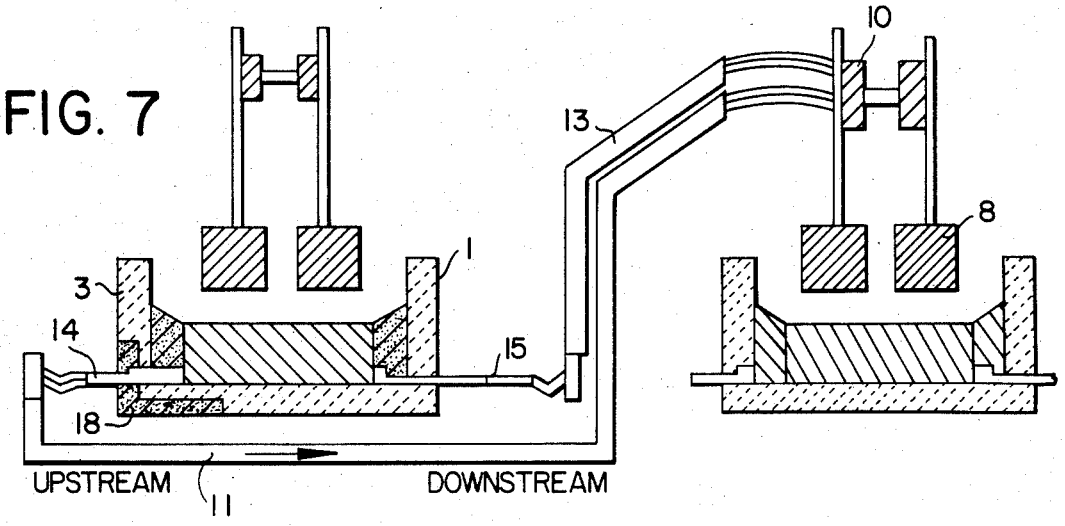

FIG. 7 shows the application of those principles, which resulted in upstream and downstream connecting circuits 11 and 13 respectively of identical section and different lengths, for the part made up of aluminum bars, with compensation in respect of the difference in ohmic resistance between the two by virtue of the restriction in section and the increase in length of the downstream cathodic output 15.

In the three situations shown in FIGS. 5, 6 and 7, it will be noted that the terminal portion of the upstream cathodic output 14 is of a slightly reduced terminal section which, however, is still larger than that of the downstream output 15. That arrangement is given by way of an embodiment of the invention but it is not a necessary feature of the invention. One of skill in the art is in fact aware that it is possible to act on the thermal balance of the cathodic blocks by modifying the section of the cathodic output in the terminal portion thereof. That arrangement which is known per se is here used in combination with the invention in its broadest sense.

In FIG. 6, the insulation of the upstream lining 18 has been locally increased and the insulation of the downstream lining 19 has been locally reduced, as concurrent measures. In FIG. 7, the insulation of the upstream lining 18 has been increased alone.

SPECIFIC EXAMPLE

A 280 kA tank was fitted with asymmetric cathodic bars and asymmetric heat insulation. The cathodic bars were extended by steel bars of smaller section. The length of the extension portions is greater on the downstream side than on the upstream side, ratio between the lengths=4.3. In that way it was possible to obtain a cathodic drop on the downstream side which is 35 mV higher than the cathodic drop on the upstream side. The weight of the aluminum conductors was thus reduced by 860 kg. The insulation at the upstream side of the tank was slightly increased, at 18, in comparison with the downstream side, thus making it possible to provide for perfect symmetry of the embankment portions. It will be noted, FIG. 7, that the upstream and downstream circuits 11 and 13 are now formed by conductors of the same cross-section, which was not the case with the prior art, FIGS. 3 and 4.

ADVANTAGES ACHIEVED BY THE INVENTION

The advantages achieved by the invention are of two kinds:

1. The amount of metal forming the outside conductors is considerably reduced. That means that the cost of the installation is reduced and moreover the space around each tank is less cluttered.

2. The reduction in section of the cathodic bars on the downstream side makes it possible for a larger amount of heat to occur within the tank than with the normal section, i.e., an enhanced Joule effect, and thermal losses by way of the steel reduced. It is possible to profit therefrom provided that the heat insulation is adequately distributed between the upstream and downstream sides, to increase the steel section on the upstream side without disturbing the thermal balance of the tank. Thus, with a constant overall heat insulation, that provides an energy saving which can be estimated at 50 kWh/ton.

We claim:

1. In a tank for the production of aluminum using the Hall-Heroult process by the electrolysis of alumina in a molten cryolite-base bath in an assembly formed by the grouping in series of a plurality of aligned tanks, each tank (1) being formed by a rectangular metal casing (2) having a major axis perpendicular to the axis of the series and whose interior comprises a heat-insulating lining (3), a cathode (4) formed by the juxtaposition in sealed relationship of carbonaceous blocks (5) in which metal cathodic bars (6) are sealed, the two ends (12, 12') of the bars, which issue from the carbonaceous blocks (5), forming the cathodic outputs which extend to the outside of the casing at the upstream and downstream sides thereof, in relation to the direction of flow of the current in the series, the upstream ends of the bars being connected to an upstream conductor (11), and the downstream ends of the bars being connected to a downstream conductor (13) for making electrical connections to the following tank (1') in the series, said conductors with the corresponding cathodic outputs forming an upstream circuit and a downstream circuit, each tank further comprising an anodic system suspended from a horizontal anodic bus assembly (10) which is adjustable in respect of height, said system comprising two lines of anodes which are parallel to the major axis of the casing, said anodes (8) which are formed by carbonaceous blocks themselves being suspended removably from the anodic bus assembly by conducting metal rods (9) of which the lower portion is sealed into the carbonaceous block, the anodic bus assembly being supplied with current by the upstream and downstream circuits of the preceding tank in the series, the improvement comprising providing an upstream conductor of substantially equal thickness as the downstream conductor, but of greater length than the downstream conductor, thereby creating greater resistance in the upstream conductor than the downstream conductor, and equilibrating the resistances in the upstream and downstream circuits by adjusting the ohmic resistances of the ends of the cathodic bars, such that the ends (15) connected to the downstream conductor (13) have a higher resistance than the ends (14) connected to the upstream conductor (11).

2. A tank according to claim 1, characterized in that equality of ohmic resistance as between the upstream and downstream circuits (11, 13) is achieved by making the downstream cathodic outputs (15) of a material having a higher degree of resistivity than that of the material forming the upstream cathodic outputs (14).

3. A tank according to claim 2, characterized in that the equality of ohmic resistance as between the upstream and downstream circuits (11, 13) is achieved by increasing the length and/or reducing the section of the downstream outputs (15).

4. A tank according to claim 1, characterized in that the equality of ohmic resistance as between the upstream and downstream circuits (11, 13) is achieved by increasing the length and/or reducing the section of the downstream outputs (15).

5. A tank according to claim 1 characterized in that the heat-insulating lining of the casing on the upstream side is increased in relation to the heat insulation on the downstream side, by preselection of the nature of or the thickness of the material forming said heat-insulating lining or on both factors at once.

* * * * *